US006521582B2

(12) United States Patent
Masschelein et al.

(10) Patent No.: US 6,521,582 B2
(45) Date of Patent: Feb. 18, 2003

(54) LAUNDRY DEVICES FOR DELIVERING DYE TRANSFER INHIBITING BENEFITS

(75) Inventors: Axel Masschelein, Brussels (BE); Patrick Firmin August Delplancke, Destelbergen (BE); Lucresse Gemma Van Wonterghem, Temse (BE); Terence Graham Curtis, Bucks (GB)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 10/170,792

(22) Filed: Jun. 12, 2002

(65) Prior Publication Data

US 2003/0004082 A1 Jan. 2, 2003

Related U.S. Application Data

(63) Continuation of application No. 09/431,552, filed on Oct. 29, 1999, now Pat. No. 6,410,496.

(51) Int. Cl.[7] ..... C11D 17/04; D06F 39/02

(52) U.S. Cl. ..... 510/297; 68/17 R; 206/0.5; 510/439

(58) Field of Search ..... 68/17 R, 235 R; 206/0.5; 510/277, 296, 297, 439

(56) References Cited

U.S. PATENT DOCUMENTS

| | | | | |
|---|---|---|---|---|
| 4,380,453 A | * | 4/1983 | Claiborne | 8/606 |
| 4,494,264 A | * | 1/1985 | Wattiez et al. | 8/150 |
| 4,835,804 A | * | 6/1989 | Arnau-Munoz et al. | 510/277 X |
| 4,969,927 A | * | 11/1990 | Schumann et al. | 68/17 R X |
| 5,698,476 A | * | 12/1997 | Johnson et al. | 442/121 |
| 5,881,412 A | * | 3/1999 | Ziskind | 9/159 |
| 5,912,221 A | * | 6/1999 | Van Leeuwen et al. | 510/360 |
| 6,035,473 A | * | 3/2000 | Felstead et al. | 68/235 R X |

FOREIGN PATENT DOCUMENTS

| | | |
|---|---|---|
| EP | 0 719 856 | * 7/1996 |
| EP | 1 026 231 | * 8/2000 |
| FR | 2761702 | * 10/1998 |
| GB | 1 356 642 | * 6/1974 |
| WO | WO 96/20996 | * 7/1996 |
| WO | WO 96/26831 | * 9/1996 |

* cited by examiner

*Primary Examiner*—Philip Coe
(74) *Attorney, Agent, or Firm*—Jerry J. Yetter; Kim William Zerby; Steven W. Miller

(57) ABSTRACT

A laundry device for use with a washing machine is provided. The laundry device includes a bag storing a water-insoluble DTI compound. The bag includes a plurality of apertures allowing wash water to flow through the bag but which substantially prevent the water-insoluble DTI compound from exiting the bag during use. The laundry device can further include a container having a compartment for receiving and dispensing a dosed amount of detergent during use.

3 Claims, 9 Drawing Sheets

LAUNDRY DEVICES FOR DELIVERING DYE TRANSFER INHIBITING BENEFITS

CROSS REFERENCE TO RELATED APPLICATIONS

This application is a continuation of U.S. application Ser. No. 09/431,552 to MASSCHELEIN et al, filed Oct. 29, 1999 (P&G Case 7842) and now U.S. Pat. No. 6,410,496.

TECHNICAL FIELD OF THE INVENTION

The present invention relates to the field of devices for use with a laundering process, and, more particularly, to the field of laundry devices for storing dye transfer inhibiting compounds.

BACKGROUND OF THE INVENTION

The laundering of colored garments is a delicate operation. Dye bleeding from fabrics and dye transfer between fabrics during the laundering process can lead to the undesirable result of color alteration of the laundered garments. The use of dye transfer inhibiting (DTI) compounds is known in the art as a means for reducing the effects of dye transfer between laundered articles. These DTI compounds, which can be provided in the form of polymers, have the ability to complex or absorb the fugitive dyes washed out of fabrics before the dyes have the opportunity to attach to other articles in the wash. Some DTI compounds include vinylpyrrolidone polymers, polyamine N-oxide polymers and copolymers of vinylpyrrolidone and N-vinylimidazole. These polymers can be water soluble or substantially water insoluble, as described in U.S. Pat. No. 5,912,221 issued to Van Leeuwen et al. on Jun. 15, 1999, the substance of which is fully incorporated herein by reference, and can be added directly to the wash water if desired. However, when too much of a DTI compound is present in the wash water, it can negate the effectiveness of laundry brighteners or fluorescent whitening agents as well as negatively impact the cleaning performance of a laundry detergent. Excessive amounts of a DTI compound in the wash water may also cause deterioration of non-extraneous dyes present on the items being laundered. In other words, even dyes that do not ordinarily give rise to bleeding in the wash water can be attacked by a DTI compound, resulting in faded or non-uniform appearances of the laundered items.

It is also known in the art to chemically bond dye scavenging compounds to a substrate, such as by covalently bonding a polyquaternary ammonium compound to a cellulosic material as described in U.S. Pat. No. 5,881,412 to Ziskind. U.S. Pat. No. 4,380,453 to Claiborne also describes an article impregnated with a dye scavenging compound. In practice, however, it has been determined that the above-described dye-scavenging approach requires an impractical size for the substrate to reduce bleeding to manageable or even acceptable levels, and is restrictive in terms of possible substrate candidates that are compatible with the dye scavenging compounds.

Yet another approach taken to reduce dye transfer during a wash process is discussed in U.S. Pat. No. 4,494,264 to Wattiez et al., wherein articles subject to dye bleeding are physically separated from the remaining laundry articles by an envelope. This approach, however, can suffer from the inconvenience of having to sort items into a confining laundry envelope, resulting in decreased cleaning due to restricted movement of the enveloped items through the wash water. In addition, this approach does not appear to provide a mechanism for restricting dye transfer among the articles within the envelope.

Therefore, there is a desire to provide methods and devices for delivering dye transfer inhibiting benefits with a simplified laundry device. Further, there is a desire to provide a laundry device which eliminates contact between the laundered articles and the DTI compound. Yet further, there is a desire to provide a laundry device which can deliver DTI benefits as well as dispense a laundry detergent. Still yet further, there is a desire to provide a laundry device which can deliver DTI benefits, wherein the DTI compound can be replaced so that the laundry device is useable over multiple washing cycles.

SUMMARY OF THE INVENTION

A laundry device for use with a washing machine is provided. The laundry device includes a bag storing a water-insoluble DTI compound. The bag includes a plurality of apertures allowing wash water to flow through the bag but which substantially prevent the water-insoluble DTI compound from exiting the bag during use. The laundry device can further include a container having a compartment for receiving and dispensing a dosed amount of detergent during use.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
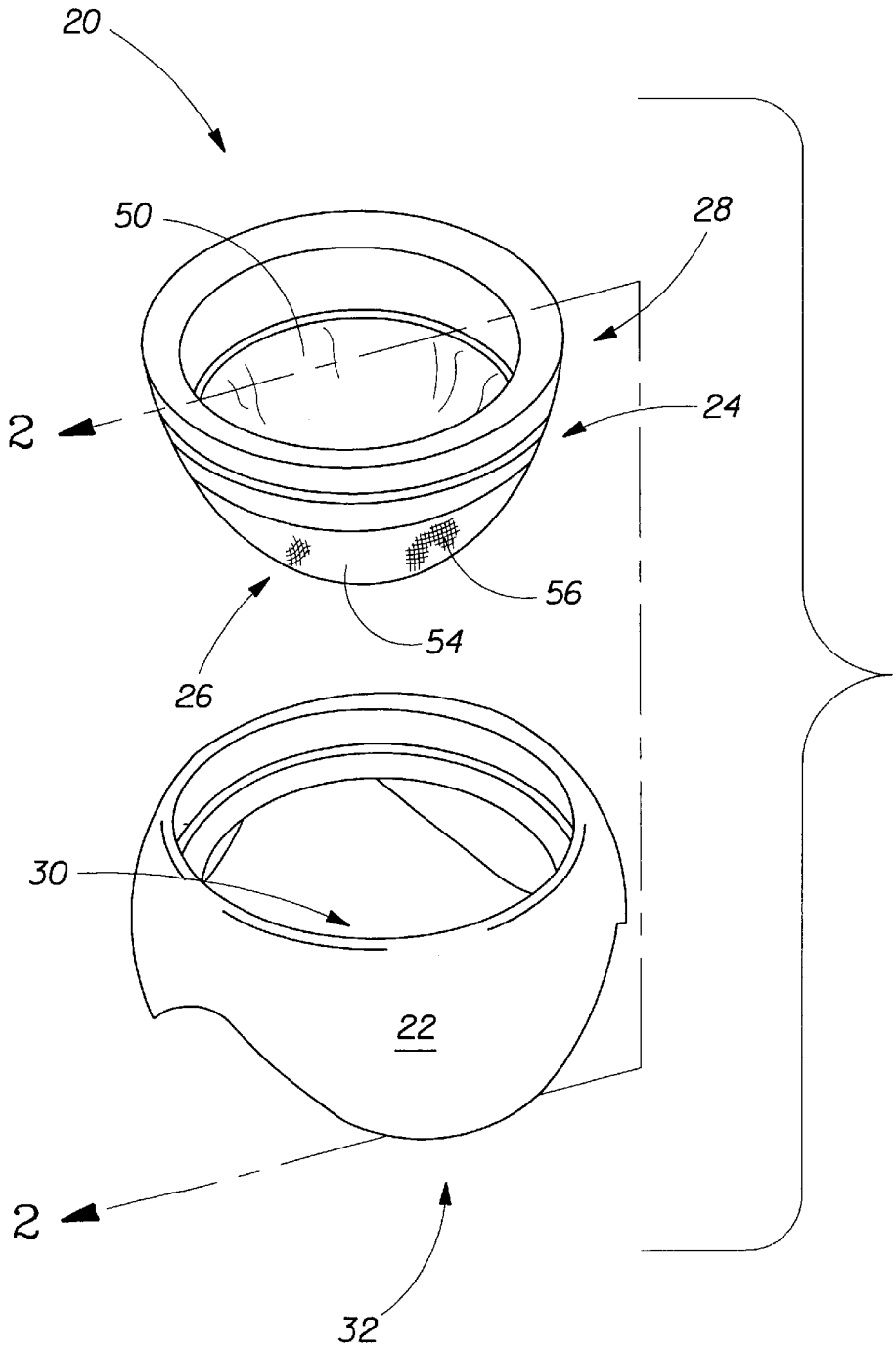
FIG. 1 is an exploded perspective view of a preferred laundry device made in accordance with the present invention.

Unless specifically indicated otherwise, those figures expressed in terms of percent (%) are understood to refer to weight-percent. Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. As discussed more fully hereafter, the present invention is directed to water permeable laundry devices having a water-insoluble dye transfer inhibiting (DTI) compound stored therein, and, more preferably, to laundry devices for dispensing laundry products, such as liquid, tablet, or powder detergents, and which further include a replaceable bag having a water-insoluble DTI compound stored therein. The laundry devices of the present invention can be used with any type of automatic washing machine, including washing machines with and without an agitator. Further, the laundry devices can freely float within the wash volume of the washing machine or can be fixedly attached to the interior of the washing machine tub.

Figure 2:
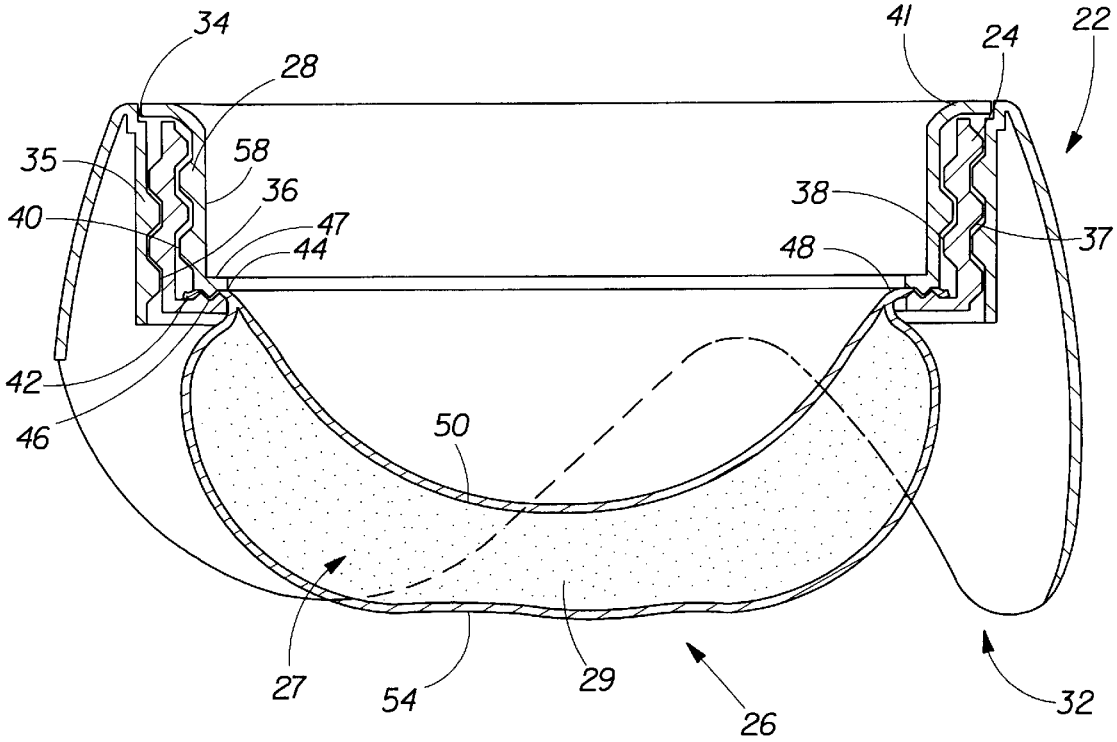
FIG. 2 is a cross-sectional side view of the assembled laundry device of FIG. 1, taken along line 2—2 thereof.
Figure 3:
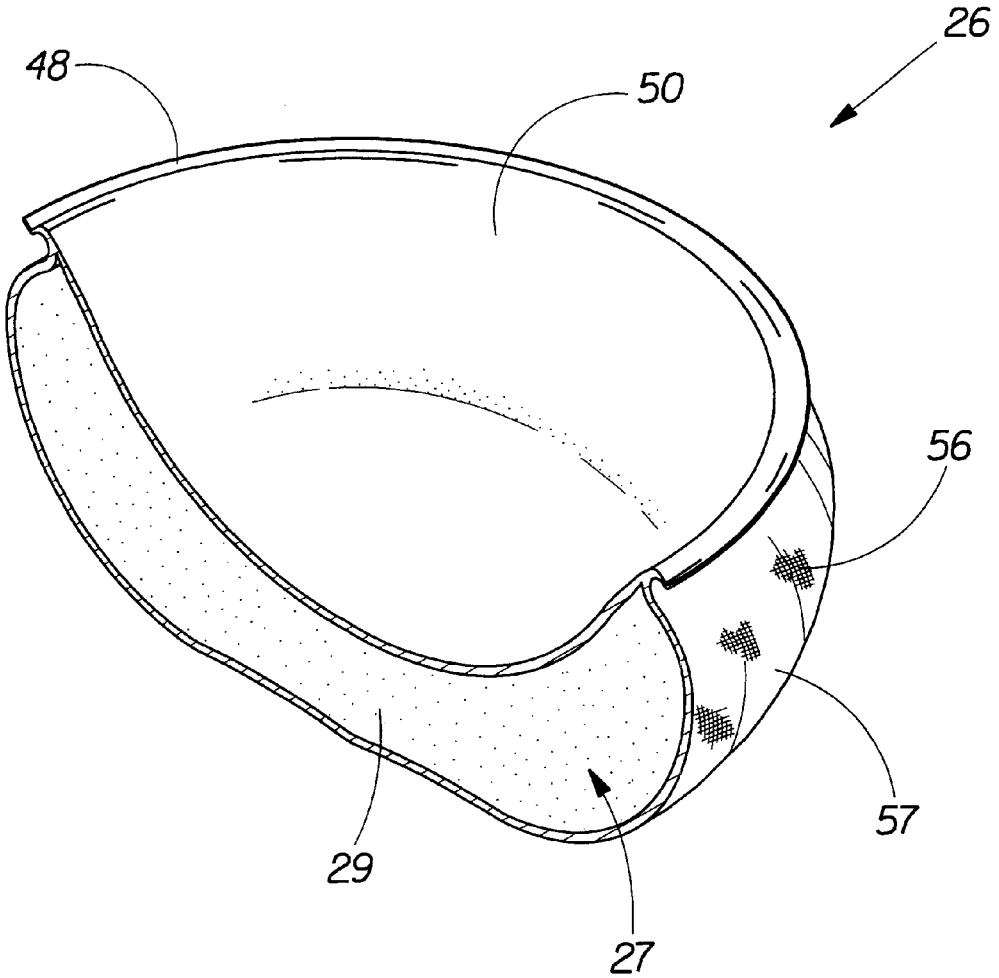
FIG. 3 is a perspective view of a preferred bag suitable for storing a water-insoluble DTI compound.

In accordance with one aspect of the present invention and with reference to FIGS. 1, 2, and 3, a preferred laundry device 20 is illustrated. The laundry device 20 has a frame 22, a connector 24, a bag 26 with compartment 27 storing a water-insoluble DTI compound 29, and a retainer 28. The frame 22 is substantially annular in shape and includes an opening 30 and a plurality of feet 32 which provide a stable platform for the laundry device 20 when it is placed upon a surface. The frame 22 has a radially extending ledge 34 located adjacent to the opening 30. An inner wall 35 depends downwardly from the ledge 34 and has a female thread 36 disposed thereabout. The connector 24 is provided in the form of a ring having, in addition to the male thread 37 disposed about the outer surface of the connector 24, a female thread 38 disposed about the inner surface of the connector 24 for engaging a male thread 40 of the retainer 28. The retainer 28 includes a radially outwardly extending flange 41 which engages the ledge 34 when the laundry device 20 is assembled. The connector 24 has a radially inward extending lip 42 with one or more concentric ridges 44 disposed about the upper surface of the lip 42. When the laundry device 20 is assembled, an extension 48 (FIG. 3) of the bag 26 is disposed between the ridges 44 and a one or more ridges 46 disposed on a radially inwardly extending lip 47 of the retainer 28. The combination of and cooperation between the ridges 44 and the ridges 46 secure the bag 26 to the dosing device 20 during use.

The upper wall 50 of the bag 26 is preferably provided in the form of a depression and, more preferably, is substantially hemispherical in shape for receiving a liquid or powder detergent 52 (FIG. 4) therein. As such, the upper wall 50 is preferably formed from a material which is impermeable to the liquid detergent 52, such as polypropylene, polyethylene, or polyamide films. As best seen in FIG. 3, the lower wall 54 of the bag 26 includes a plurality of apertures 56 through which the laundry wash water can flow but which restrict movement of the water-insoluble DTI particles 29 from the compartment 27 of the bag 26 into the washing volume of a washing machine. While the apertures 56 are illustrated as discrete portions of the lower wall 54 for clarity, it will be understood that more or less than the entire lower wall 54 may contain the apertures 56. As used herein, the term "apertures" is intended to refer to any random or predetermined opening through which the wash water can flow. For example, the apertures 56 can be randomly formed as part of a non-woven fabric or can be formed as part of predetermined discrete pattern. The apertures 56 are sized to prevent the water-insoluble DTI compound 29 from exiting the compartment 27 of the laundry device 20 and preferably have an average aperture open area (i.e., the area through which the wash water can flow) which is less than about 20 $mm^2$ and, more preferably, is between about $4\times10^{-3}$ $mm^2$ and about 5 $mm^2$. The total open area of the apertures 56 of the lower wall 54 is at least about 20 $mm^2$ and, more preferably, is between about 50 $mm^2$ and about $500\times10^3$ $mm^2$. For apertures formed as non-discrete patterns (e.g., such as in a non-woven fabric), the aperture open area can be characterized according to the air permeability of the material forming the wall, as measured by ISO method 9237. The air permeability of the material forming the wall 54 is at least about 100 $L/m^2/s$ and more preferably is at least about 500 $Lm^2/s$. Most preferably, the air permeability of the material forming the wall 54 is at least about 1000 $L/m^2/s$. The volume of the compartment 27 is at least about 1 $cm^3$ and, more preferably, between about 5 $cm^3$ and about 1000 $cm^3$ which is sufficient to store between about 1 g and about 500 g of the water-insoluble DTI compound 29. This amount of DTI compound can be sufficient for between about 1 and about 20 uses in a standard wash cycle lasting 10 to 120 minutes. More preferably, the water-insoluble DTI compounds confined in the compartment of the bag of the laundry devices of the present invention, when tested according the Dye Removal Test Method described more fully hereafter, remove at least about 10% of the test dye after 15 wash test cycles and more preferably at least about 25% of the test dye at 15 wash test cycles. Most preferably, the DTI compounds confined in the compartment of the bag of the laundry devices of the present invention remove at least about 50% of the test dye after 15 wash test cycles. The volume of the compartment 27 can be increased or decreased to accommodate more or less of the water-insoluble DTI compound 29 as desired. The compartment 27 can be permanently sealed such that the bag 26 is discarded when the DTI compound 29 has become ineffective or the bag 26 can be fitted with a resealable closure, as known in the art, so that the ineffective DTI compound 29 can be emptied from the compartment 27 of the bag 26 and the compartment 27 refilled with new DTI compound 29. For example, a zipper or a hook and loop type closure could be fitted to the bag 26.

The laundry devices of the present invention can be used with a variety of liquid, granular or tablet laundry detergents where it is desirable to deliver dye-transfer benefits. Exemplary liquid laundry detergents include those disclosed in U.S. Pat. No. 5,275,753, issued Jan. 4, 1994, to Boutique et al., U.S. Pat. No. 5,223,179, to Connor et al., issued Jun. 29, 1993 and U.S. Pat. No. 5,565,145, to Watson et al., issued Oct. 15, 1996, all of which are incorporated by reference. Also useful are the nonaqueous liquid laundry detergents exemplified by U.S. Pat. No. 5,945,392, issued Aug. 31, 1999, to Boutique et al., hereby incorporated by reference.

In addition to liquid detergent products, water-insoluble detergent products may also be used with the laundry devices of the present invention. Examples of suitable water-insoluble detergent products are the granular detergent products disclosed in U.S. Pat. No. 5,762,647, to Brown et al., issued Jun. 9, 1998 and the compact detergent products of U.S. Pat. No. 5,691,294, to France et al., issued Nov. 25, 1997, both of which are incorporated by reference. Also suitable as water-insoluble detergents are granular products compressed into a tablet form such as those described in U.S. Pat. No. 4,219,435, to Biard et al., issued Aug. 26, 1980 and European Patent Application No. 896,053A1, published Feb. 2, 1999, both of which are incorporated by reference. Another type of laundry product which may be used with the laundry devices of the present invention is liquid fabric softener products, such as U.S. Pat. No. 5,804,219, to Trinh et al., issued Sep. 8, 1998, which is hereby incorporated by reference.

Figure 4:
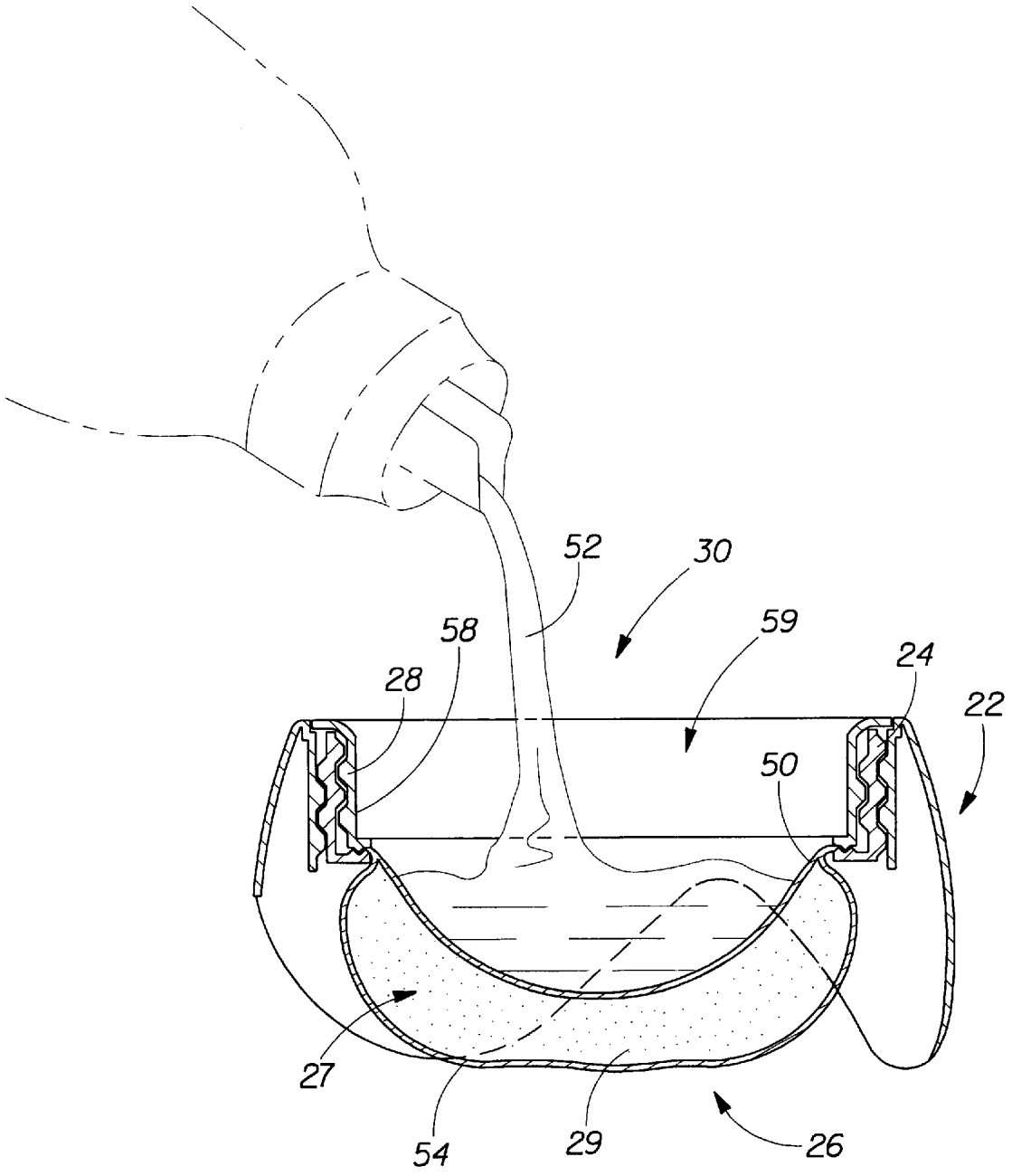
FIG. 4 is partial cross-sectional side view of the laundry device of FIG. 2, wherein a liquid detergent is shown dispensed into the device.

The laundry device 20 is assembled by first positioning the bag 26 so that the extension 48 of the bag 26 is disposed over the lip 42 of the connector 24. The retainer 28 is then threadedly advanced into the connector 24 until the lip 47 of the retainer 28 engages the extension 48 of the bag 26 such that the grooves 46 and ridges 44 cooperate to secure the bag 26 to the combination of the connector 24 and the retainer 28. This combination is then threadedly advanced into the opening 34 of the frame 22 until the flange 41 of the retainer 28 engages the ledge 34 of the frame 22. As shown in FIG. 4, the liquid laundry detergent 52 is poured through the opening 30 of the frame 22 and into the depression formed by the inner wall 50 of the bag 26. A compartment 59 storing the liquid laundry detergent 52 is formed by a combination of the upper wall 50 of the bag 26 and the inner surface 58 of the retainer 28, as best seen in FIG. 4. The upper wall 50 of the bag 26 as well as the inner surface 58 of the retainer 28 can be provided with dosing lines to assist in dispensing predetermined amounts of the laundry detergent 52 into the laundry device 20. As will be appreciated, the ridges 44 and grooves 46, in addition to securing the bag 26 to the laundry device 20, also provide a substantially liquid tight seal at the bag, connector, and retainer interface so that the liquid laundry detergent 52 does not leak out of the compartment 59. The frame 22, connector 24, and retainer 28 can be formed from a thermoplastic material, such as polyethylene, polystyrene, or nylon, by injection molding.

Figure 5:
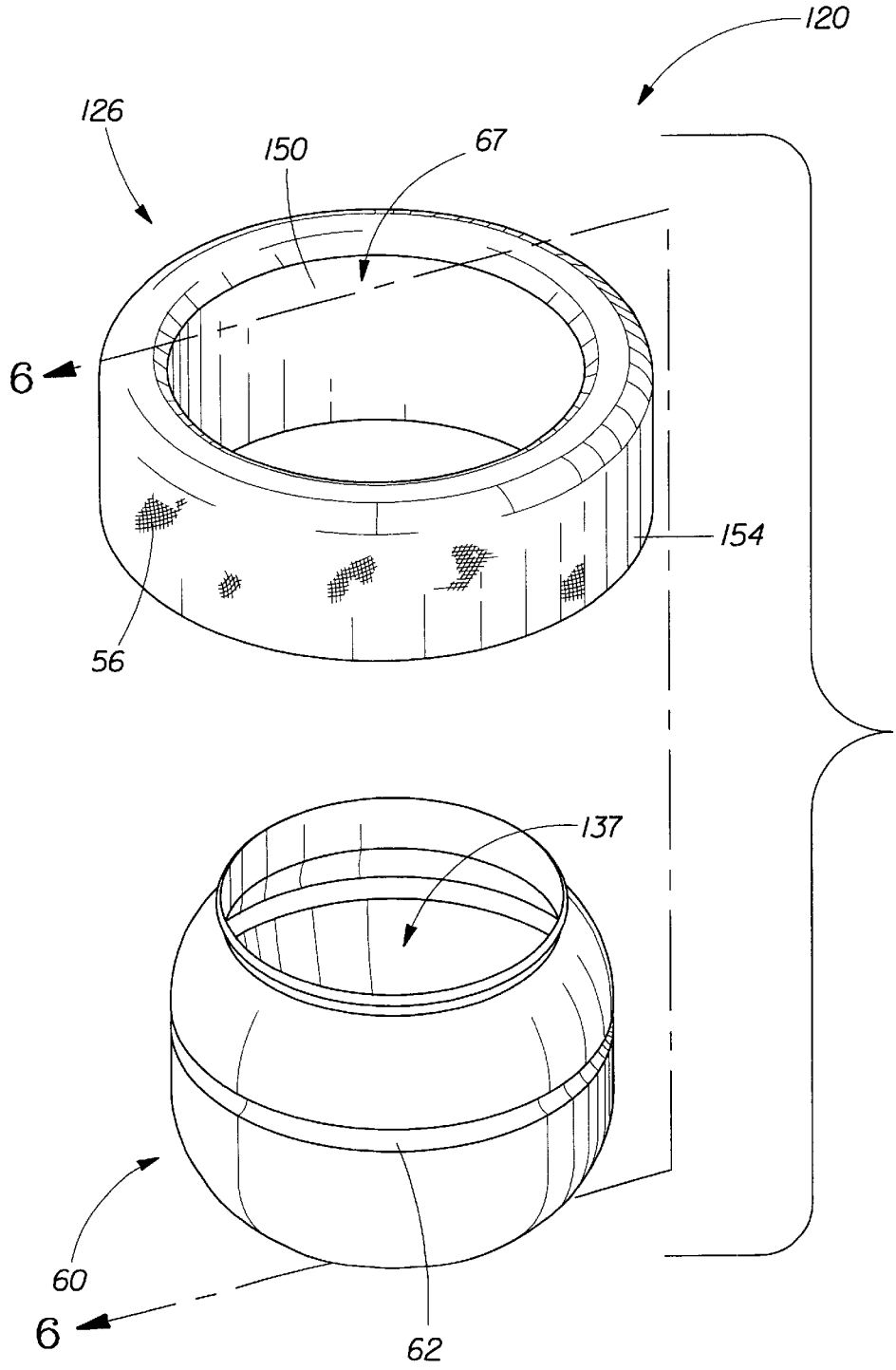
FIG. 5 is an exploded perspective view of another preferred laundry device made in accordance with the present invention.
Figure 6:
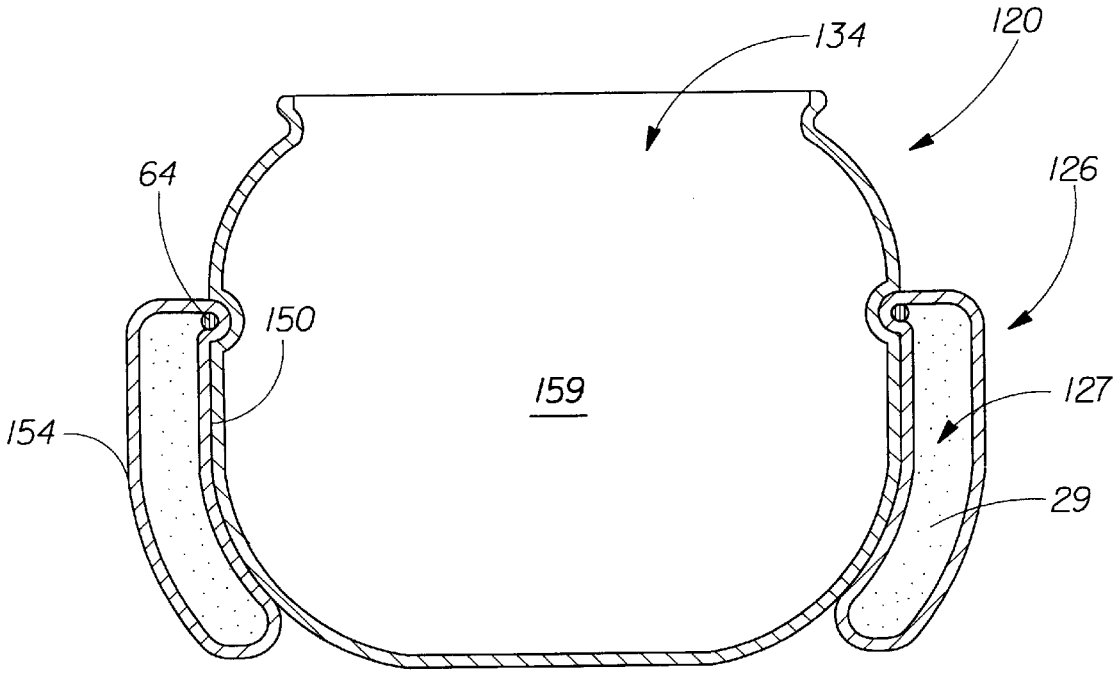
FIG. 6 is a cross-sectional side view of the laundry device of FIG. 5, taken along line 6—6 thereof.
Figure 7:
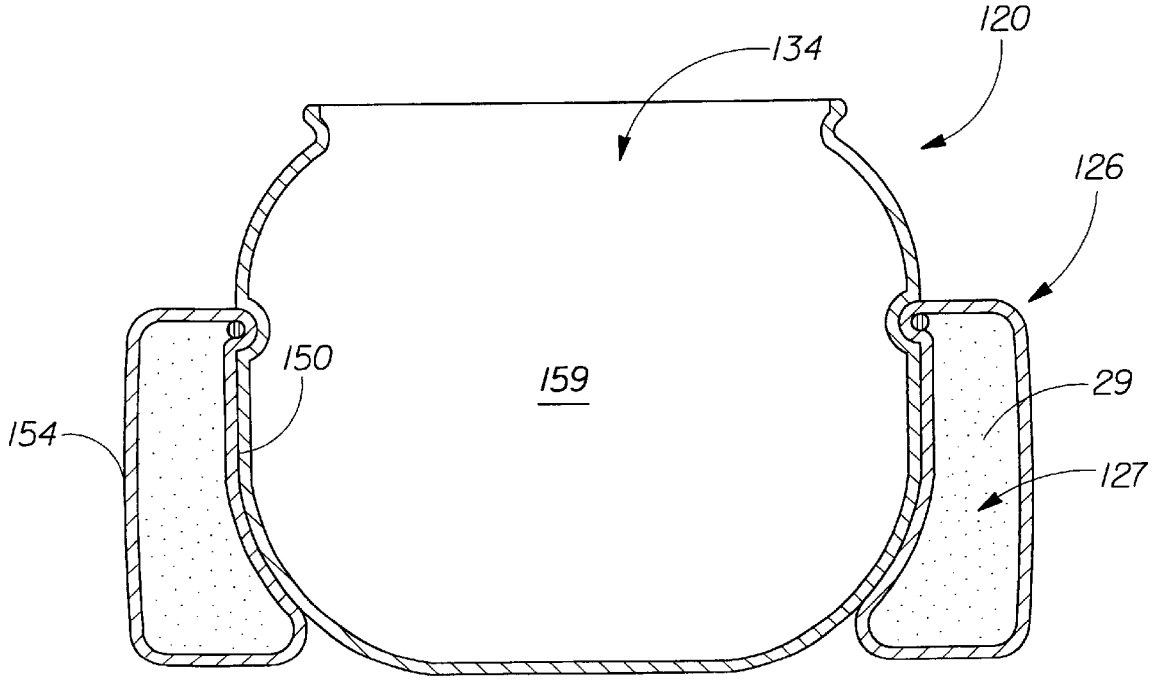
FIG. 7 is a perspective view of the laundry device of FIG. 5, wherein the bag is illustrated in its swollen state.

Referring to FIGS. 5 and 6, another preferred laundry device 120 made in accordance with the present invention is illustrated. The laundry device 120 comprises a bag 126 generally in the form of ring and a container 60 having a compartment 159 for storing, for example, the liquid detergent 52. The container 60 has an opening 134 through which the liquid detergent 52 is poured into compartment 159. The circumference of the container 60 increases in the direction from the opening 134 of the container 60 toward the mid-section of the container. The container 60 also includes a groove 62 at about the midpoint of the container which cooperates with an elastomeric retaining ring 64 disposed adjacent the opening 67 of the bag 126. The retaining ring 64 is used to secure the bag 126 about the laundry device 120 during use. The inside circumference of the retaining ring 64, when the ring 64 is in a relaxed state, is preferably less than the smallest circumference of the groove 62. The laundry device 120 is assembled by sliding the bag 126 over the upper portion of the container 60 until the retaining ring 64 cooperates with the groove 62 of the container 60. As the bag 126 traverses the upper portion of the container 60, the opening 67 of the bag 126 expands to accommodate the increasing circumference of the container 60. Because the inside circumference of the retaining ring 64 when the ring 64 is in a relaxed state is preferably less than the smallest circumference of the groove 62, the retaining ring 64 will be in tension when it engages the groove 62. This force retains the bag 126 about the laundry device 120 during use in a washing machine. Some DTI compounds of this invention exhibit the property to swell when exposed to water or to a wash medium. A schematic representation of such swelling is illustrated in FIG. 7. The swelling can, in some cases, reach 200 to 300% of the volume of the DTI compound in its dry state. For example, polyvinyl N-oxide (PVNO) cross linked by about 0.5% (w/w) of divinylbenzene (DVB) over a DTI monomer can swell up to about 200% of its original volume. Typically, the degree of swelling is related to the degree of cross linking, wherein the greater the degree of cross linking, the lower the amount of swelling which occurs. As such, the dimensions or the material of the bag can be chosen in such a way that the bag can accommodate the swelling of the DTI compound without rupturing. For instance, the inner and/or outer walls 150 and 154 of the bag 126 can be made from an elastic material which can accommodate the swelling. Alternately, the volume of the compartment 127 of the bag 126 can be sized to accommodate the swelling of the DTI compound.

The container 60 can be formed by injection molding from polyethylene or any other material as is known in the art. The inner and outer walls 150 and 154 of bag 126 are preferably formed from non-woven, spun-bonded or spun-bonded/melt-blown sandwich polypropylene while the elastomeric ring 64 can be formed from any elastomer which is compatible with the liquid detergent 52, as is known in the art. The inner and/or outer walls 150 and 154 of the bag 126 have a plurality of apertures 56 which allow adequate flow of the wash water into the compartment 127 of the bag 126 which stores the water-insoluble DTI compound 29 in order to deliver the dye transfer inhibiting benefit. As previously discussed with respect to the laundry device 20, however, the apertures 56 retain the water-insoluble DTI compound 29 within the compartment 127 of the bag 126 during use.

Figure 8:
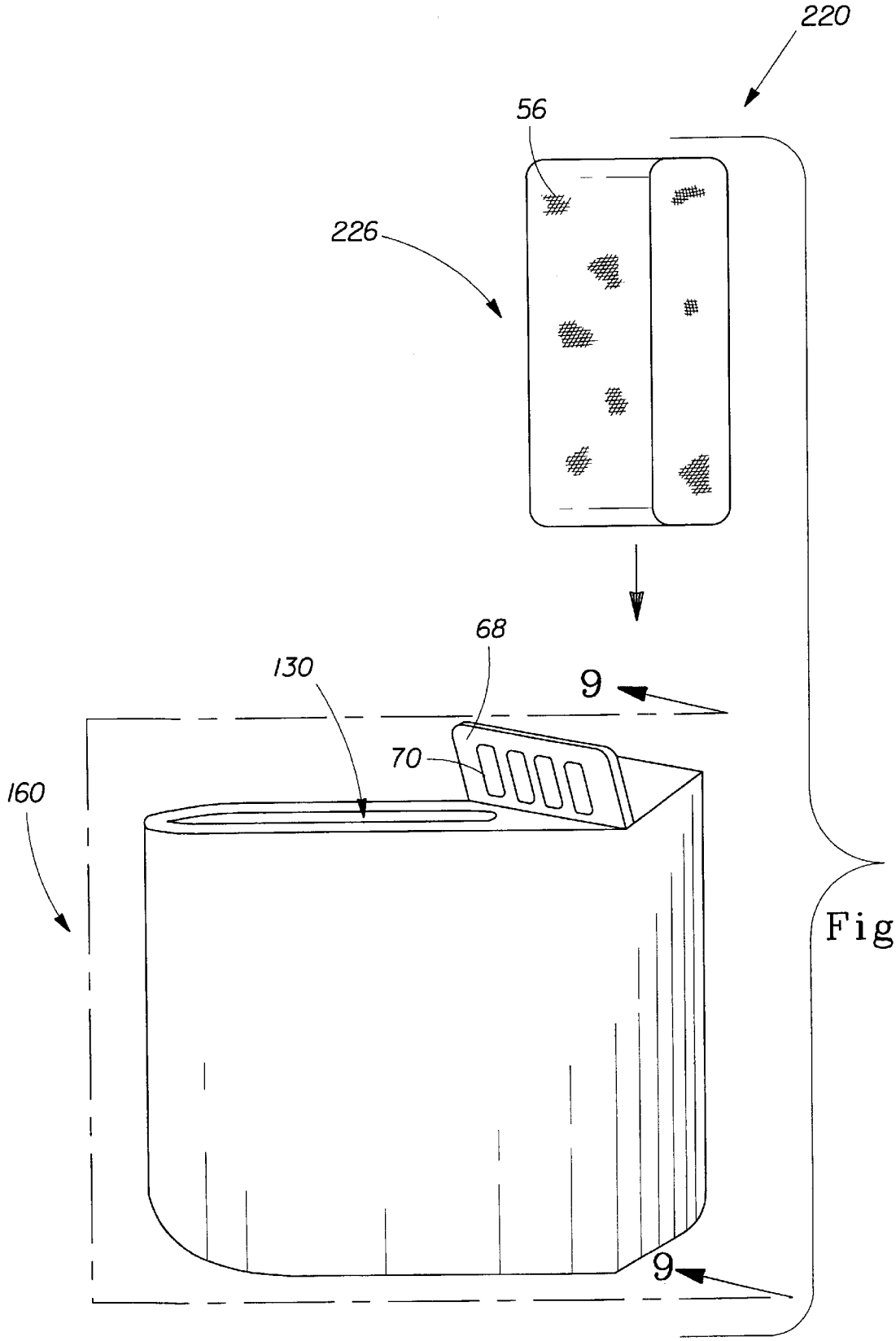
FIG. 8 is an exploded perspective view of yet another preferred laundry device made in accordance with the present invention.
Figure 9:
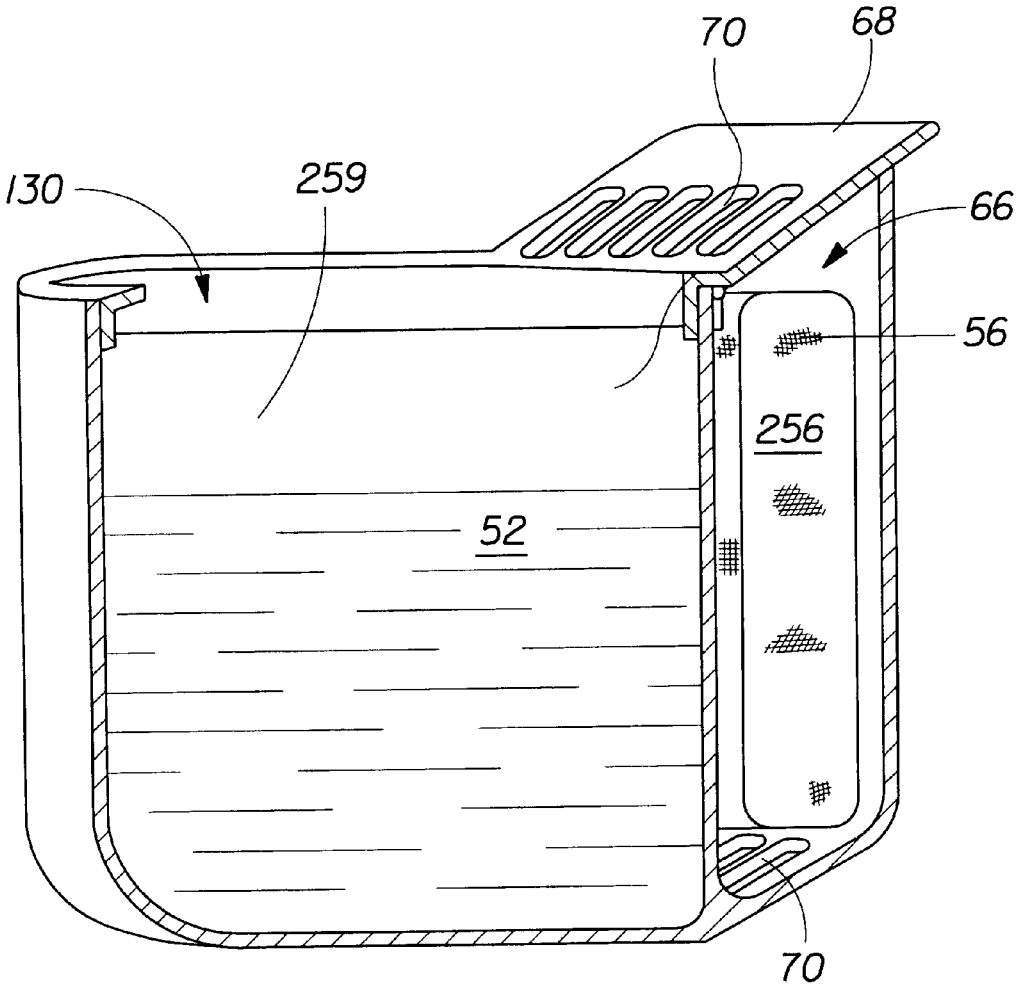
FIG. 9 is a cross-sectional side view of the assembled laundry device of FIG. 8, taken along line 9—9 thereof.

Referring to FIGS. 8 and 9, yet another preferred laundry device 220 made in accordance with the present invention is illustrated. The laundry device 220 includes a container 160 with a compartment 259 for storing the liquid detergent 52. A chamber 66 is disposed adjacent to the compartment 259 for receiving a bag 226 having a water-insoluble DTI compound (not illustrated). The chamber 66 is preferably closed by a lid 68 attached by a hinge 72 to the container 160 adjacent the opening 130 of the container 160. The lid 68 further includes a securing mechanism, such as a clip, prong, or other structure known in the art, for releasably securing the lid 68 in a closed position to retain the bag 226 within the chamber 66 during use in a washing machine. The lid 68 and/or one or more of the outside walls (i.e., walls which are exposed to the wash water) which form the chamber 66 contain a plurality of slits 70 which allow the wash water to flow into and out of the chamber 66 so that the bag 226 can deliver a DTI benefit to the wash water.

Figure 10:
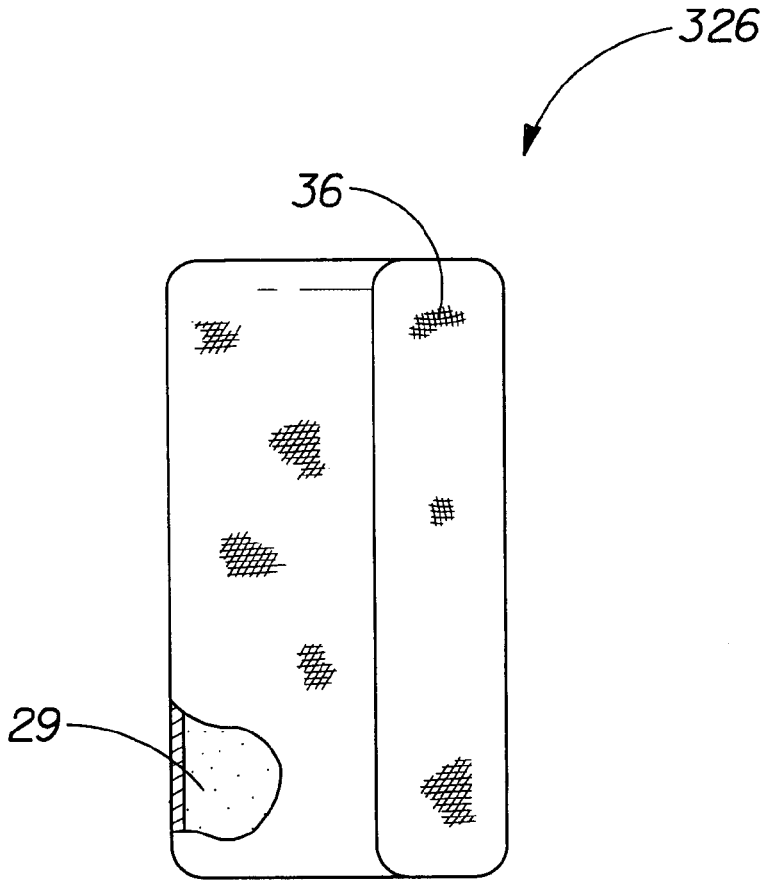
FIG. 10 is perspective view of a bag made in accordance with the present invention, wherein a portion of the bag has been removed to expose a compartment storing a water-insoluble DTI compound.

While the laundry devices of the present invention are described herein as comprising a bag in combination with a container which can also dose a laundry detergent to the wash water during use, the bags of the present invention can also be used individually by merely placing the bag directly in the wash water of the washing machine, or by attaching it to the drum or the agitator of the washing machine through mechanical or other means. For example, as shown in FIG. 10, a bag 326 having a plurality of apertures 56 and storing a water-insoluble DTI compound 29 could be placed directly in the wash water. Preferably, the water-insoluble DTI compound 29 of the bag 326 would comprise a solid cross-linked polyvinyl N-oxide, as discussed more fully hereafter. Bags made in accordance with the present invention which are suitable for use individually can be provided in a variety forms, but will at least contain a compartment for storing a water-insoluble DTI compound and have a plurality of apertures, as previously described.

The laundry devices of the present invention can be used with a variety of water-insoluble DTI compounds 29. These water-insoluble DTI compounds can be provided as a solid, gel, and the like. These DTI compounds can deliver the dye transfer inhibiting benefit by a variety of techniques, including, but not limited to trapping the dye in such a manner that it is unavailable for re-deposition onto a fabric, precipitating out the dye or adsorbing, absorbing or otherwise becoming associated with any extraneous dyes in the wash water. As used herein, the phrase "substantially water insoluble" is intended to mean that the DTI compound has a solubility in deionized water at 20° C. of less than about 1 gm/liter. A substantially water insoluble DTI compound may comprise a water-soluble dye transfer inhibiting agent which is bound to a water insoluble carrier, or it may comprise a dye transfer inhibiting agent which in itself is water insoluble. Water insoluble carriers for water soluble polymeric agents include inorganic materials such as zeolites, clays such as kaolinites, smectites, hectorite types, silicas (or other detergent ingredients). Additionally, organic water-insoluble materials such as fatty alcohols, esters of fatty acids, or polysaccharides that can form water-insoluble gels upon hydration (e.g. gellan gum, carrageenan gum, agarose etc.) can be used as carriers herein. For the dye transfer inhibiting agents which are themselves water insoluble, water insolubility can be achieved by cross-linking, either starting from the known water soluble dye transfer inhibiting polymeric agents, or starting from monomers of these polymers. Other compounds that are suitable as water insoluble DTI agents are any compound exhibiting ion exchange properties, preferably anion exchangers. For instance, non-limiting examples of such products are Dowex® exchange resins of the Dow Chemical Co. or equivalent from other suppliers; Sephadex®, Sepharose® or Sephacel® exchange resins all from Pharmacia Biotech; any other polysaccharide having ion exchange properties such as modified cellulosics, starches; other derivatives of the wood industry such as wood pulp or lignin.

Water soluble polymeric dye transfer inhibiting agents that are suitable to be bound to insoluble carriers, or to be made insoluble via cross-linking are those polymers known in the art to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Especially suitable polymeric dye transfer inhibiting agents are polyamine N-oxide polymers, polymers and copolymers of N-vinylpyrrolidone and N-vinylimidazole, vinyloxazolidones, vinylpyridine, vinylpyridine N-oxide, other vinylpyridine derivatives or mixtures thereof.

a) Polyamine N-oxide Polymers

The polyamine N-oxide polymers suitable for use contain units having the following structure formula:

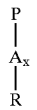

(I)

wherein

P is a polymerisable unit, whereto the R—N—O group can be attached to or wherein the R—N—O group forms part of the polymerisable unit or a combination of both.

A is $\overset{O}{\overset{\|}{NC}}$, $\overset{O}{\overset{\|}{CO}}$, $\overset{O}{\overset{\|}{C}}$, —O—, —S—, —N—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

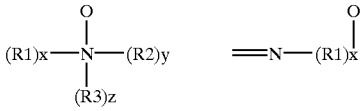

wherein

R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine, quinoline, acridine and derivatives thereof. Another class of said polyamine N-oxides comprises the group of polyamine N-oxides wherein the nitrogen of the N—O group is attached to the R-group. Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed has dye transfer inhibiting properties. Examples of suitable polymeric backbones are polyvinyls, polyalkylenes, polyesters, polyethers, polyamide, polyimides, polyacrylates and mixtures thereof. The amine N-oxide polymers of the present invention typically have a ratio of amine to the amine N-oxide of about 10:1 to about 1:1000000. However the amount of amine oxide groups present in the polyamine oxide polymer can be varied by appropriate copolymerization or by appropriate degree of N-oxidation. Preferably, the ratio of amine to amine N-oxide is from about 2:3 to about 1:1000000. More preferably from about 1:4 to about 1:1000000, and most preferably from about 1:7 to about 1:1000000. The polymers of the present invention actually encompass random or block copolymers where one monomer type is an amine N-oxide and the other monomer type is either an amine N-oxide or not. The amine oxide unit of the polyamine N-oxides has a pKa<10, preferably pKa<7, more preferred pKa<6. The polyamine oxides can be obtained in almost any degree of polymerisation. The degree of polymerization is not critical provided the material has the desired dye-suspending power. Typically, the average molecular weight is within the range of about 500 to about 1000,000; preferably from about 1,000 to about 50,000, more preferably from about 2,000 to about 30,000, and most preferably from about 3,000 to about 20,000.

b) Copolymers of N-vinylpyrrolidone and N-vinylimidazole

The N-vinylimidazole N-vinylpyrrolidone polymers used in the present invention have an average molecular weight range from about 5,000 to about 1,000,000, preferably from about 5,000 to about 200,000. Highly preferred polymers for use in the laundry detergent compositions according to the present invention comprise a polymer selected from N-vinylimidazole N-vinylpyrrolidone copolymers wherein said polymer has an average molecular weight range from about 5,000 to about 50,000; more preferably from about 8,000 to about 30,000; and most preferably from about 10,000 to about 20,000. The average molecular weight range was determined by light scattering as described in Barth H. G. and Mays J. W. Chemical Analysis Vol 113,"Modem Methods of Polymer Characterization". Highly preferred N-vinylimidazole N-vinylpyrrolidone copolymers have an average molecular weight range from about 5,000 to about 50,000; more preferably from about 8,000 to about 30,000; most preferably from about 10,000 to about 20,000. The N-vinylimidazole N-vinylpyrrolidone copolymers characterized by having said average molecular weight range provide excellent dye transfer inhibiting properties. The N-vinylimidazole N-vinylpyrrolidone copolymer of the present invention has a molar ratio of N-vinylimidazole to N-vinylpyrrolidone from about 1 to about 0.2, more preferably from about 0.8 to about 0.3, and most preferably from about 0.6 to about 0.4.

c) Polyvinylpyrrolidone

Polyvinylpyrrolidone ("PVP") having an average molecular weight from about 2,500 to about 400,000 can also be utilized; preferably from about 5,000 to about 200,000; more preferably from about 5,000 to about 50,000; and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696).

d) Polyvinyloxazolidone

One may also utilize polyvinyloxazolidone as a polymeric dye transfer inhibiting agent. Said polyvinyloxazolidones have an average molecular weight from about 2,500 to about 400,000; preferably from about 5,000 to about 200,000; more preferably from about 5,000 to about 50,000; and most preferably from about 5,000 to about 15,000.

e) Polyvinylimidazole

One may also utilize polyvinylimidazole as polymeric dye transfer inhibiting agent. Said polyvinylimidazoles have an average molecular weight from about 2,500 to about 400,000; preferably from about 5,000 to about 200,000; more preferably from about 5,000 to about 50,000; and most preferably from about 5,000 to about 15,000.

f) Cationic Polymers

Such polymers are those having a cationic group into their polymeric backbone, as shown by the formula:

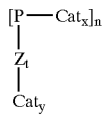

(II)

Wherein P represents polymerisable units, Z represents alkyl or aryl groups, oxygen or ester, ether, amide, amine group, Cat represents cationic groups, preferably including quaternized N groups or other cationic units, x=0 or 1, y=0 or 1, t=0 or 1. Preferred cationic polymers are quaternized polyvinylpyridines.

Water insolubility can, in the case of non-cross linked polymers, also be achieved by selecting very high molecular weight range, or by copolymerizing, or by varying the degree of oxidation if appropriate, depending on the polymer. Polymers which are water soluble, such as those described in U.S. Pat. No. 5,912,221, may be made insoluble if the molecular weight is increased above 400,000.

g) Cross-linked Polymers

Cross-linked polymers are polymers whose backbone are interconnected to a certain degree; these links can be of chemical or physical nature, possibly with active groups on the backbone or on branches; cross-linked polymers have been described in the Journal of Polymer Science, volume 22, pages 1035–1039. In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in U.S. Pat. No. 5,912,221.

Thus, a cross-linked polymer has one or more individual molecular chains linked by side branches to adjacent chains. The cross-links can be formed: (a) between already existing linear or branched polymers, (b) during the polymerization of multi-functional monomers, or (c) during the polymerization of dimeric monomers with traces of multi-functional monomers. The cross-linking can also be achieved by various means known in the art. For instance, the cross-links can be formed using radiation, oxidation and curing agents, such as divinylbenzene, epichlorohydrin and the like. Preferably, cross-linked polymers for the purpose of this invention are those obtained by cross-linking a water-soluble dye tranfer inhibiting polymer described above with divinylbenzene (DVB) cross-linking agent during polymerisation of the DTI monomer. Cross-linking degree can be controlled by adjusting the amount of divinylbenzene (DVB) cross-linking agent. Preferably, the degree of cross-linking is between about 0.05% (w/w) of DVB over DTI monomer and about 50% of DVB over DTI monomer and, more preferably, between about 0.05%(w/w) of DVB over DTI monomer and about 25%(w/w) of DVB over DTI monomer. Most preferably, the degree of cross-linking is between about 0.1%(w/w) of DVB over DTI monomer and about 5%(w/w) of DVB over DTI monomer. The cross linking forms DTI compound particles, at least 90% (and more preferably at least about 95%) of which have a minimum diameter as measured by conventional methods for particle size distribution evaluation of at least about 1 $\mu$m, preferably at least about 50 $\mu$m, and more preferably at least about 75 $\mu$m, all as measured in their dry state. Most preferably, the cross linking forms DTI compounds, at least 90% (and more preferably at least about 95%) of which have a minimum diameter as measured by conventional methods for particle size distribution evaluation of between about 1 $\mu$m and about 5 mm, still more preferably between about 50 μm and about 2500 μm, and yet still more preferably between about 75 μm and about 1500 μm, all as measured in their dry state. Preferably, the cross-linked polymer is a polyamine N-oxide or a quaternized polyamine. The skilled in the art may conveniently obtain such compounds by oxidizing or quaternizing cross-linked polyvinylpyridines from Reilly Industries Inc. commercialized under the name Reillex™ 402 or Reillex™ 425 by methods known in the art. For instance, but not exclusively, the method described in U.S. Pat. No. 5,458,809 can be used to prepare a polyamine N-oxide of interest from the commercially available compounds given above. An example of quaternized polyamine can also be obtained from Reilly Industries under the commercial name Reillex™ HPQ.

The laundry devices of the present invention are used in the same manner as conventional laundry dosing and dispensing devices known in the art. In other words, the subject laundry devices (e.g., a bag or a bag in combination with a container storing a laundry product) can be placed directly in the wash water prior to the start of a wash cycle or can be attached or suspended to the interior of a washing machine tub. The laundry devices of the present invention can also be stored within a package, such as a carton, shipping container, or other article of manufacture, having instructions in association therewith for using the laundry device to deliver a dye transfer inhibiting benefit to the wash water. As used herein, the phrase "in association with" is intended to refer to refer to instructions that are either directly printed on the package or container itself or presented in a different manner including, but not limited to, a brochure, print advertisement, electronic advertisement, audio, audio-visual, and the like, so as to communicate the set of instructions to a consumer of the article of manufacture. For example, the set of instructions could comprise the following steps for delivering a dye transfer inhibiting benefit to the wash water:

1. For a bag stored within a package, either:
   (a) placing the bag directly in the wash water or attaching it to the drum or the agitator of the washing machine, or
   (b) assembling the bag with a container, filling the container with a laundry product, and placing the combination of the bag and container in the wash water;
2. For a bag and container stored within a package,
   (a) assembling the bag with a container; and
   (b) filling the container with a laundry product, and placing the combination of the bag and container in the wash water.

DYE REMOVAL TEST METHOD

The following procedure is useful for characterizing the dye removal efficiency of the water-insoluble DTI compounds and materials forming the bags storing these compounds which are made in accordance with the present invention. Specific units may be suggested in connection with measurement and/or calculation of parameters described in the procedures. These units are provided for exemplary purposes only. Other units consistent with the intent and purpose of the procedures can be used.

Three glass marbles and 2.4 g of the detergent composition set forth in Table 1 are added to a Launder-O-Meter pot meeting the requirements of ISO 105-C01-6. For DTI compounds that are incompatible with anionic surfactants such as cationic polymers described under f) above, fully non-ionic detergent compositions may also be used to assess dye removal efficiency. Exemplary Launder-O-Meter and pots are the Washtec series which are manufactured by Roaches Engineering, Inc. of the United Kingdom for wash and dry clean fastness testing.

TABLE 1

| Ingredient | % (w/w) |
|---|---|
| Sodium linear alkylbenzene sulfonate | 15 |
| Alcohol ethoxylate | 10 |
| Sodium citrate (as citric acid) | 1 |
| Soap (as free fatty acid) | 10 |
| Propane diol | 9 |
| Ethanol | 2 |
| Monoethanolamine (adjust to pH 7.8–8.0) | 7 |
| Silicone antifoam agent | 0.5 |
| Demineralized water | Balance |

The pot solution is brought to 300 mL by adding an appropriate amount of demineralized water. To this pot solution is added 1.33±0.01 mL. of a solution of direct blue 1 dye at 2.27 mM concentration (~0.225% w/w). This yields an absorbance as defined by Beer's law of about 0.70 at 620 nm. A 5 cm wide×5 cm long bag, which is made from the subject apertured material (i.e., the apertured material to be tested), containing 1.00±0.01 g of the subject water-insoluble DTI compound (i.e., the DTI compound to be tested), is added to the pot.

The pot containing the dye solution, the DTI bag and the detergent composition is agitated for 0.50±0.02 hours at 40.0±2.0° C. in the Launder-O-Meter. After 0.5 hours, the bag is immediately removed and rinsed thoroughly. The pot solution is filtered after cooling to room temperature over a 0.5 μm filter to remove any matter in suspension and the residual absorbance of the dye solution is measured at 620 nm. Repeat the operation 15 times, using the same bag containing the same DTI compound but using a fresh dye solution aliquot and a fresh detergent dose at each cycle throughout the test. The absorbance values at 620 nm versus the initial absorbance of the untreated dye solution at the same wavelength reflect the ability of the DTI bag to remove the dye from the wash solution over repeated exposure to dye in solution, in the presence of a laundry detergent. Dye removal efficiency is calculated from the following equation:

$$\%_{Removal} = \left(1 - \frac{\text{Absorbance at Cycle } n}{\text{Initial Absorbance}}\right)100$$

According to this test method, substantially water-insoluble DTI compounds and apertured materials made in accordance with the present invention have a Dye Removal Efficiency of at least about 10% dye removal after 15 test wash cycles and preferably at least about 25% dye removal after 15 test wash cycles. Most preferably, laundry devices of the present invention achieve at least about 50% dye removal after 15 test wash cycles.

The following is an illustrative example of application of the Dye Removal Test Method:

EXAMPLE 1

A water-insoluble DTI compound comprising cross-linked polyvinylpyridine N-oxide (0.5% divinylbenzene cross-linking degree) is placed in a spunbonded polypropylene non-woven material of 60 gr/m$^2$ weight. The initial absorbance of the dye at 620 nm is measured to be 0.71±0.01 as previously described. After completing the above-described 15 cycles, the dye absorbance at 620 nm is measured to be 0.16±0.01. Therefore, the subject substantially water insoluble DTI compound and apertured material have a Dye Removal Efficiency of about 77% dye removal after 15 test wash cycles.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A laundry device for use with a washing machine, comprising:

a water-insoluble dye transfer inhibiting compound selected from the group consisting essentially of polyvinylpyridine N-oxide, quaternized polyvinylpyridine, polyvinylpyrrolidone, poly(vinylpyrrolidone-co-vinylimidazole), and mixtures thereof, wherein said water-insoluble dye transfer inhibiting compound has an average particle size of at least about 75 $\mu$m; and a bag storing said water-insoluble dye transfer inhibiting compound, wherein at least a portion of said bag is formed from a material having a plurality of apertures allowing wash water to flow through said bag but substantially preventing said water-insoluble dye transfer inhibiting compound from exiting said bag during use.

2. The laundry device of claim 1, wherein said water-insoluble dye transfer inhibiting compound is cross linked and wherein the degree of said cross-linking is obtained with amounts of cross-linking agent between about 0.05% and about 25% by weight dye transfer inhibiting monomer.

3. The laundry device of claim 1, wherein said water-insoluble dye transfer inhibiting compound is a water-soluble dye transfer inhibiting polymer bound to a water-insoluble carrier.

* * * * *